US006652397B1

(12) United States Patent
Lamson

(10) Patent No.: US 6,652,397 B1
(45) Date of Patent: Nov. 25, 2003

(54) ADHESIVE BALL RETRIEVAL AND GUARD SYSTEM FOR SPORTS EQUIPMENT

(76) Inventor: William J. Lamson, P.O. Box 3278, Gilbert, AZ (US) 85234

( * ) Notice: Subject to any disclaimer, the term of this patent is extended or adjusted under 35 U.S.C. 154(b) by 0 days.

(21) Appl. No.: 10/150,800

(22) Filed: May 17, 2002

(51) Int. Cl.[7] ..... A63B 49/00
(52) U.S. Cl. ..... 473/517; 473/553
(58) Field of Search ..... 473/517, 553, 473/286

(56) References Cited

U.S. PATENT DOCUMENTS

| | | | | | |
|---|---|---|---|---|---|
| 3,874,666 | A | * | 4/1975 | Ross | 473/517 |
| 4,210,327 | A | * | 7/1980 | Schubert | 473/517 |
| 4,815,738 | A | * | 3/1989 | DiFranco | 473/517 |
| 4,834,393 | A | * | 5/1989 | Feldi | 473/474 |
| 4,993,712 | A | * | 2/1991 | Urwin | 473/517 |
| 5,333,854 | A | * | 8/1994 | Woollard et al. | 473/517 |
| 5,947,850 | A | * | 9/1999 | Gray | 473/517 |

FOREIGN PATENT DOCUMENTS

| | | | | |
|---|---|---|---|---|
| DE | 3205862 | * | 8/1983 | A63B/47/02 |
| FR | 2594037 | * | 8/1987 | A63B/47/02 |
| GB | 1363348 | * | 8/1974 | A63B/47/02 |
| GB | 2086735 | * | 5/1982 | A63B/49/00 |

* cited by examiner

*Primary Examiner*—Raleigh W. Chiu
(74) *Attorney, Agent, or Firm*—Donald W. Meeker

(57) ABSTRACT

A piece of sports equipment for striking a ball or other sports object is covered along an exposed edge with one side of an adhesive mating hook and loop fastener. A smaller mating strip of adhesive mating hook and loop fastener is interconnected with the mating portion on the equipment leaving the adhesive side exposed for picking up the ball or other sports object with the piece of sports equipment. Alternately one or two strips of double adhesive material, such as tape may be used.

9 Claims, 2 Drawing Sheets

ADHESIVE BALL RETRIEVAL AND GUARD SYSTEM FOR SPORTS EQUIPMENT

BACKGROUND OF THE INVENTION

1. Field of the Invention

This invention relates to sporting equipment generally, and specifically to ball or other sports object retrieval systems for tennis and other sports employing a racquet, stick, bat and other like playing equipment for striking a ball or other sports object, wherein a guard is applied to the playing equipment with a replaceable adhesive segment for ball retrieval.

2. Description of the Prior Art

During the long history of sports employing equipment to strike a ball or other sports object, such as tennis employing a racquet or other sports employing a club, bat, stick or other ball striking means, players have been forced to bend or crouch to recover the ball after play. This task is particularly strenuous to elderly and handicapped players, who are well represented in these sports. Thus the desire for a ball retrieval device to free the player from frequent, repetitive bending, crouching and stooping has long been recognized by players of these sports.

Another problem with sports employing equipment to strike balls or other sports objects, such as shuttlecocks or pucks, is that the ball striking equipment often strikes other surfaces and become damaged or scraped detracting from its appearance or operation.

Often in an attempt at ball retrieval the ball striking equipment will be scraped on the ground. This is especially true in tennis, where the racquet is often used as a scoop to scoop up a ball, and simultaneously scrape the ground.

The number and diversity of devices spawned in the attempt to fulfill this need demonstrate both the long felt need for a solution, and the nonobviousness of the solution presented by the subject invention. Note for example, some of the devices designed to recover tennis balls: U.S. Pat. No. 3,874,666, April, 1975 Ross; U.S. Pat. No. 4,834,393, May, 1989 Feldi; U.S. Pat. No. 4,053,156, October, 1977 Bai; U.S. Pat. No. 5,458,328, October, 1995 Dubose; U.S. Pat. No. 4,004,806, January, 1977 Malik; U.S. Pat. No. 4,116,436, September, 1978 Bjorhn; U.S. Pat. No. 4,575,081, March, 1986 Cavanagh; U.S. Pat. No. 4,568,089, February, 1986 Jenkins; U.S. Pat. No. 4,948,129, August, 1990 Bartasius; U.S. Pat. No. 4,919,421, April, 1990 Vandeveld; U.S. Pat. No. 4,895,366, January, 1990 Bartasius; U.S. Pat. No. D355,232, February, 1995 Hodges; U.S. Pat. No. 5,056,786, October, 1991 Bellettini; U.S. Pat. No. 4,210,327, July, 1980 Schubert; U.S. Pat. No. 4,993,712, February, 1991 Urwin; U.S. Pat. No. 4,045,068, August, 1977 Nelson; U.S. Pat No. 4,114,881, September, 1978 Norton; U.S. Pat. No. 4,997,185, March, 1991 Bartasius.

None of these inventions provide the most desirable and effective solution. These attempts have been plagued by elaborate and excessively expensive design, intrusion on play, unpleasing, obtrusive and commercially undesirable aesthetics, and ineffectiveness.

Previous fastener systems been designed to retrieve tennis balls with the player's racquet have major drawbacks. U.S. Pat. No. 3,874,666, April, 1975 Ross, uses a hook material (ex. Velcro) affixed to the end of the tennis racquet. This system does not retrieve tennis balls reliably because a tennis ball's standard covering, especially when worn, is not effectively adhered by the hook element of a hook and loop fastener system.

U.S. Pat. No. 4,834,393, May, 1989, Feldi, uses a strip of hook material attached to the tennis racquet by its adhesive tape backing and a tennis ball specially covered in loop fastener material. The drawback of this system is that it requires a specially designed tennis ball, increasing expense, decreasing the flexibility of use of the system, and intruding on play by introducing a ball with unusual flight characteristics.

U.S. Pat. No. 5,056,786, October, 1991 Bellettini, adopted a similar strategy, but used an supplementary loop fastener covering over a tennis ball, rather than redesigning the tennis ball with a loop fastener cover. This design intrudes on play by changing the playing characteristics of the ball.

U.S. Pat. No. 4,997,185, March, 1991 Bartasius and U.S. Pat. No. 4,210,327, July, 1980 Schubert, use a specially designed tennis racquet with a flat or concave butt containing hook fastener material designed to engage the nappy surface of the tennis ball.

These designs are of doubtful effectiveness because hook material will not securely grasp all tennis balls. The Schubert design is difficult and expensive to implement because it calls for a specially designed racquet, substantially increasing expense and decreasing the players choice of racquets. As an additional limitation, none of the above designs retrieve playing objects other than fresh, nappy tennis balls.

Other devices in the prior art present a variety of problems. U.S. Pat. No. D355,232, February, 1995 Hodges, depicts a cumbersome device, intruding on playing ability. U.S. Pat. No. 4,993,712, February, 1991 Urwin is difficult to apply, requiring careful aim to retrieve the ball. U.S. Pat. No. 4,045,068, August, 1977 Nelson, and U.S. Pat. No. 4,114,881, September, 1978 Norton, are not racquet based at all, but require an additional, cumbersome and expensive retrieval device. These devices are intended for retrieving numerous balls after a practice session, not for the continuous, effortless retrieval of balls during play.

Still other designs carry elaborateness and expense to an extreme. U.S. Pat. No. 5,458,328, October, 1995 Dubose, and others use a specially designed net to capture tennis balls, creating a significant additional expense. These devices are limited in function to the capture of balls hit into the net only. Other designs employ expensive special netting and duct work or other elaborate devices to return balls to the players. See, for example, U.S. Pat. No. 4,004,806, January, 1977 Malik; U.S. Pat. No. 4,116,436, September, 1978 Bjorhn; U.S. Pat. No. 4,575,081, March, 1986 Cavanagh; U.S. Pat. No. 4,568,089, February, 1986 Jenkins; U.S. Pat. No. 4,948,129, August, 1990 Bartasius; U.S. Pat. No. 4,895,366, January, 1990 Bartasius. These systems are too expensive for most players, do not capture or retrieve all balls played, do not work in sports other than tennis, and therefore do not accomplish the goal of eliminating bending to retrieve struck playing balls.

A number of devices have been designed to retrieve golf balls in play. See, for example, U.S. Pat. No. 5,326,145, July, 1994 Lee; U.S. Pat. No. 4,254,981, March, 1981 Wilson. These mechanical devises are not club mounted, but are mounted to a rod to retrieve balls from mud, water and other hazardous and difficult to reach areas. The inventions cited are characteristic of the designs for retrieval of golf balls. Not club mounted, they require the player to carry an additional device. Many golf ball retrieval designs are effective, but are designed solely for the retrieval of balls caught in difficult to reach places. These devices do not aim at assisting the player in recovering a ball in play and within reach and to eliminate the need to bend over to retrieve the ball. And they would be impractical and unsuited to this task.

To be useful, a ball retrieval system must be racquet-mounted, effective at grasping the ball, inexpensive, light weight, and must not increase wind resistance to the playing stick during play. Previously attempted solutions have been plagued by elaborate and expensive design, intrusion on play, aesthetic obtrusiveness, and ineffectiveness.

What is needed is a system for using the ball striking equipment as a means for picking up the ball during play without bending and without damaging the ball striking equipment, while maintaining the normal playability of the ball and ball striking equipment.

SUMMARY OF THE INVENTION

An object of the present invention is to allow the player to retrieve the tennis ball, racquet ball, or other racquet, stick or bat based sport playing object (ball) by touching and lifting the ball with the racquet, club, bat or other ball striking equipment, relieving the player of the need to bend, stoop or crouch to retrieve the ball.

A further object of the present invention is to cover and guard the portion of the playing equipment normally scraped or banged during play or ball retrieval.

Another object of the present invention is to provide a system for easily and frequently replacing the adhesive ball retrieving surface used in the invention to maintain its usefulness.

An additional object of the present invention is to provide a system for retrieving balls that is effective with the existing type of ball used in the sport.

One more object of the present invention is to provide a system for ball retrieval and protection of the ball striking equipment In brief, the present invention uses a strip of tape having a tacky, strongly adhesive exterior surface attached to ball striking equipment, such as on a racquet frame and/or strings, by two sided adhesive tape, adhesive hook and loop (Velcro type) fastener, adhesive glue, or other adhesive system. The strip of tape or adhesive hook and loop fastener or other adhesive means not only serves to pick up the ball, but also serves to cover a normally scraped and banged portion of the ball striking equipment and protect its surface from damage.

Its strong, tacky adhesive surface reliably and consistently grasps balls of all types, including tennis balls, whether new or worn. Easy and inexpensive replacement of the adhesive strip enables the strip to be replaced whenever necessary to maintain its effectiveness.

In the tennis application the adhesive system of the present invention is attached to the exterior of the racquet frame and/or the strings. The player touches the tape to the ball and lifts. A similar application retrieves racquetball and squash balls. In the golf application, the invention is attached to the topmost tip of the putter shaft. The player turns the putter upside down and touches the tape to the ball, and lifts. Similar applications can be made in other racquet, club, bat and stick based sports.

An advantage of the present invention is that it provides a simple, economical, effective and reliable system for ball retrieval and ball striking equipment protection.

Another advantage of the present invention is that it has a broad scope of application and can be applied to any ball striking sports equipment with no need for other special equipment.

An additional advantage of the present invention is that it is always available for use since it is applied to the ball striking equipment which is in the hands of the user.

One more advantage of the present invention is that it is unobtrusive, fits snugly to the equipment, and does not interfere with normal play.

A further advantage of the present invention is that it makes possible the retrieval of playing objects without the need to bend, stoop or crouch, and be particularly useful and popular among older, handicapped and less flexible players, and players who have back problems. The device will thus make sports possible for many who otherwise would be unable to play.

Yet another advantage of the present invention is that it is applicable to a number of sports, and is especially useful in tennis and racquetball and squash where balls must be retrieved from the ground, court or deck frequently and repeatedly. Golfers will also appreciate the ability of the device to retrieve golf balls from the hole or green after play.

The present invention constitutes a new use of adhesive tape, adhesive cloth, and/or adhesive hook and loop (Velcro type) fastener tape or cloth. And the use of tacky adhesive tape constitutes a new method for ball retrieval. No prior-art device has used a tacky adhesive strip attached to the racquet or other ball striking equipment to grasp and retrieve a ball or other playing object, as well as to protect the ball striking equipment. Fastener tape has not been used with tacky adhesive to pick up a standard covered tennis ball or other ball or playing object on a standard playing court or field, with standard ball striking equipment.

No previously attempted solution has offered as simple, elegant, economical, portable, practical and effective a solution as the present invention.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
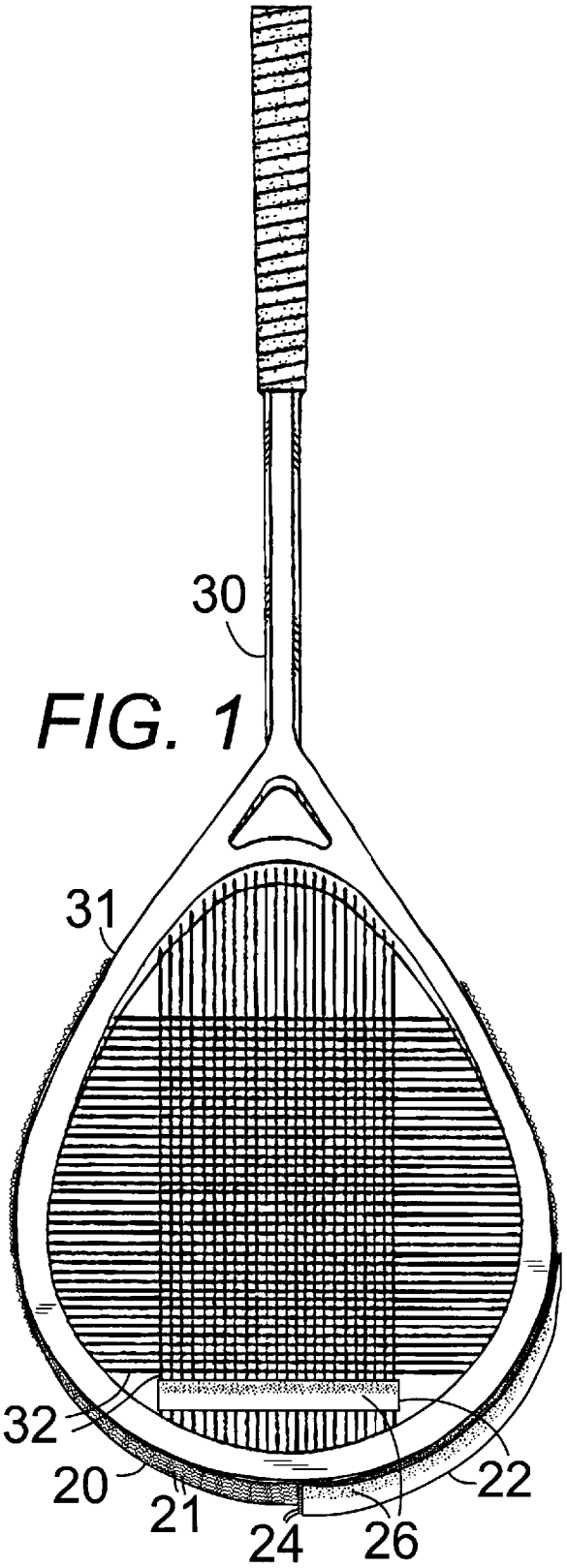
FIG. 1 is a perspective view of a racquet with a long strip of adhesive loop fastener material attached around the edge of most of the head of the racquet and a small strip of adhesive hook fastener attached to the loop fastener with the adhesive surface exposed for retrieving balls.
Figure 2:
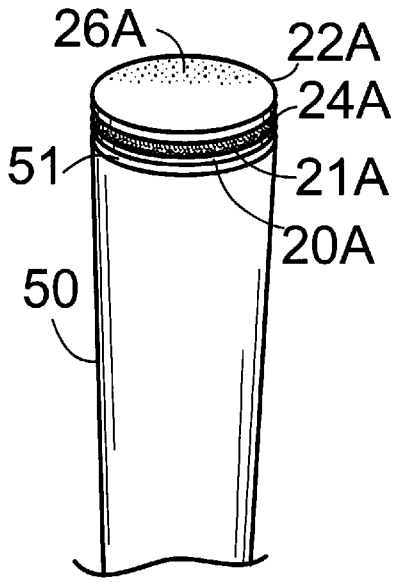
FIG. 2 is a partial perspective view of an end handle of a piece of sports equipment showing the invention applied to an end face of the end handle.
Figure 3:
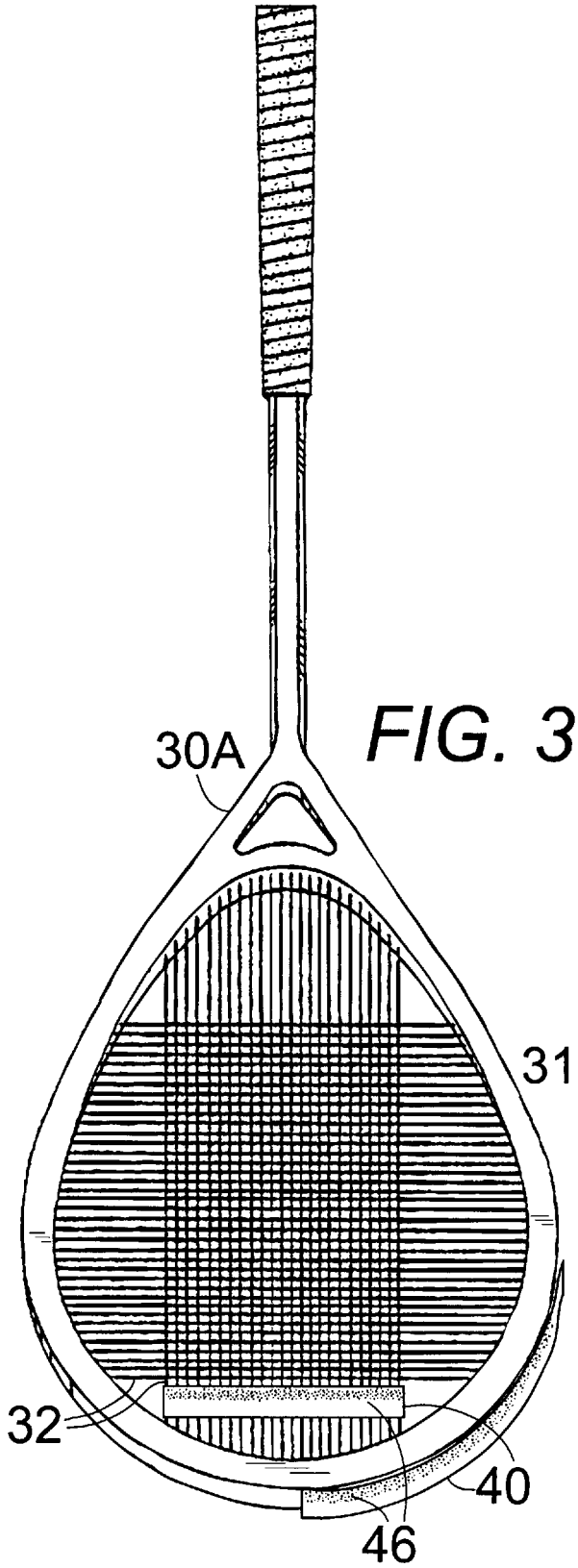
FIG. 3 is a perspective view of a racquet with a strip of double-sided adhesive tape applied to an edge of the racquet for retrieving balls.

In FIGS. 1–3, a system for retrieving a sports object of play, such as a ball, shuttlecock, puck or other moving object used in sports, normally struck by another piece of sports equipment, such as a racquet, bat, stick, club, or other striking means, comprises at least one strip of material 20 and 22, 20A and 22A, and 40 attached to a piece of sports equipment, such as a racquet 30 or golf club type equipment 50, used in striking a sports object of play, such as a tennis ball or golf ball, the at least one strip of material having an exposed adhesive surface 26 and 26A which is capable of receiving and retaining the sports object adhered thereto so that the piece of sports equipment is capable of retrieving the sports object and picking it up without the user having to bend over to retrieve it.

In FIGS. 1 and 2, the strip of material comprises a first adhesive strip 20 of one component of a mating hook and loop fastener having an adhesive side of the first strip attached to the piece of sports equipment 30 with the one component, such as a loop side 21 of the mating hook and loop fastener, exposed and a second adhesive strip 22 of another component of the mating hook and loop fastener having a mating face such as a hook side 24, attached to the first strip with the two components of the mating hook and loop fasteners interconnected and an adhesive surface 26 of the second strip exposed to form the exposed adhesive surface for picking up the sports object of play, the tennis ball in this case.

In the preferred embodiment of FIG. 1 a portion of the sports equipment normally subject to damage from striking external surfaces, the outer edge of the head 31, is covered by the first strip 20 to protect it from damage caused by striking the ground or other external objects. The second strip 22 only covers a portion of the first strip 20 that will be used for picking up the tennis balls, in this case. This strip 22 is easily replaceable for maintaining a strong adhesive surface 26 for picking up the balls.

In FIG. 3, the strip of material comprises a strip of double sided adhesive material 40, such as double sticky tape, having a first adhesive side attached to the piece of sports equipment and a second adhesive side 46 outwardly exposed to forming the exposed adhesive surface for picking up the sports objects, in this case regulation play tennis balls.

Alternately, a first strip of double sticky tape may be applied around the entire head similar to the loop strip 20 of FIG. 1 and a second strip of double sided adhesive material attached to the strip of double sided adhesive material attached to the piece of sports equipment, similar to the hook material 22 attached to the loop material of FIG. 1.

In FIG. 1 an alternate placement of the adhesive mating hook and loop fasteners may be on the strings 32 adjacent to the frame with the mating sides of the mating hook and loop fasteners connected across the strings and possibly woven in through the strings and the adhesive surface 26 of the adhesive mating hook and loop fasteners exposed to pick up the ball.

In FIG. 3 an alternate placement of a strip of material 40 having at least one adhesive side has the strip attached directly to the strings by threading a loop of the strip of material through the strings or around the strings and attaching the strip of material to itself by overlapping opposite ends of the strip of material with the adhesive side 46 facing outward, thereby forming the exposed adhesive surface.

In FIG. 2 in an alternate embodiment of the invention, the piece of sports equipment has an end handle 50, such as a golf club handle, having an end face 51 and the adhesive system of the invention is attached to the end face 51 of the handle 50. In this case, a loop strip 20A of the adhesive mating hook and loop fastener is attached by the adhesive side to the end face 51 of the handle 50 with the loop face 21A exposed and a hook face 24A of a hook strip 22A of the adhesive mating hook and loop fastener is mated with the loop strip leaving the adhesive surface 26A exposed on the end face of the handle for picking up golf balls in this case.

Other types of adhesive surfaces may be employed and other types of protective surfaces for covering vulnerable portions of the sports equipment.

It is understood that the preceding description is given merely by way of illustration and not in limitation of the invention and that various modifications may be made thereto without departing from the spirit of the invention as claimed.

What is claimed is:

1. A system for retrieving a sports object of play normally struck by another piece of sports equipment, the system comprising:

at least one strip of material attached to a piece of sports equipment used in striking a sports object of play, the at least one strip of material having an exposed adhesive surface which is capable of receiving and retaining the sports object adhered thereto so that the piece of sports equipment is capable of retrieving the sports object;

wherein the at least one strip of material comprises a first adhesive strip of one component of a mating hook and loop fastener having an adhesive side of the first strip attached to the piece of sports equipment with the one component of the mating hook and loop fastener exposed and a second adhesive strip of another component of the mating hook and loop fastener attached to the first strip with the two components of the mating hook and loop fasteners interconnected and an adhesive surface of the second strip exposed to form the exposed adhesive surface.

2. The system of claim 1 wherein a portion of the sports equipment normally subject to damage from striking external surfaces is covered by the first strip to protect the portion of the sports equipment.

3. The system of claim 2 wherein the second strip covers a portion of the first strip.

4. The system of claim 1 wherein the piece of sports equipment is a racquet having a head with a peripheral frame and interior strings, and the at least one strip of material is attached to the peripheral frame.

5. The system of claim 1 wherein the piece of sports equipment is a racquet having a head with a peripheral frame and interior strings, and the at least one strip of material is attached to the strings adjacent to the frame.

6. The system of claim 1 wherein the piece of sports equipment is a racquet having a head with a peripheral frame and interior strings, and the at least one strip of material comprises a strip of material having one adhesive side wherein the strip of material capable of being attached directly to the strings by threading a loop of the strip of material through the strings and attaching the strip of material to itself by overlapping opposite ends of the strip of material with the adhesive side facing outward, thereby forming the exposed adhesive surface.

7. The system of claim 1 wherein the piece of sports equipment has an end handle having an end face and the at least one strip of material is attached to the end face of the handle.

8. The system of claim 1 wherein the at least one strip of material is positionable on the piece of ports equipment in any desired location which facilitates picking up the sports object without forcing a user to bend over.

9. A system for retrieving a sports object of play normally struck by another piece of sports equipment, the system comprising:

at least one strip of material attached to a piece of sports equipment used in striking a sports object of play, the at least one strip of material having an exposed adhesive surface which is capable of receiving and retaining the sports object adhered thereto so that the piece of sports equipment-is capable of retrieving the sports object;

wherein the at least one strip of material comprises a strip of double sided adhesive material having a first adhesive side attached to the piece of sports equipment;

a replaceable second strip of double sided adhesive material having an inner side removably attachable to the at least one strip of double sided adhesive material attached to the piece of sports equipment and an outer side forming the exposed adhesive surface.

* * * * *